United States Patent [19]

McCallister

[11] 3,979,188

[45] Sept. 7, 1976

[54] PARTIAL OXIDATION CARBON REMOVAL PROCESS

[75] Inventor: Robert A. McCallister, Mountain Lakes, N.J.

[73] Assignee: Foster Wheeler Energy Corporation, Livingston, N.J.

[22] Filed: Oct. 25, 1974

[21] Appl. No.: 518,007

[52] U.S. Cl. ..... 48/215; 48/197 R

[51] Int. Cl.[2] ..... C01B 2/14

[58] Field of Search ..... 48/197 R, 215, 214, 48/196; 260/449 M; 210/21, 43; 55/22

[56] References Cited

UNITED STATES PATENTS

| | | | |
|---|---|---|---|
| 3,010,813 | 11/1961 | Clarke et al. | 48/215 |
| 3,147,093 | 9/1964 | Dille et al. | 48/215 |
| 3,349,029 | 10/1967 | Cheng | 48/196 X |
| 3,615,297 | 6/1970 | Dille et al. | 48/196 R |
| 3,671,209 | 6/1972 | Teichmann et al. | 48/215 |
| 3,709,669 | 1/1973 | Marion et al. | 48/215 |
| 3,866,411 | 2/1975 | Marion et al. | 48/215 |

*Primary Examiner*—R.E. Serwin

*Attorney, Agent, or Firm*—Marvin A. Naigur; John E. Wilson

[57] ABSTRACT

Unreacted carbon produced during the partial oxidation of fossil fuel is removed from the reactor gaseous effluent with water, resulting in a carbon-water slurry. The carbon-water slurry is concentrated to about five to seven percent by weight of carbon mixed with fuel and injected into the reactor for the dual purposes of utilizing the carbon contained in the slurry as the feedstock for the partial oxidation process and the water as a temperature moderator for the reactor.

5 Claims, 2 Drawing Figures

PARTIAL OXIDATION CARBON REMOVAL PROCESS

BACKGROUND OF INVENTION

This invention relates to improvements in the process of partial oxidation of petroleum feedstocks to produce synthesis gas and related products therefrom. In particular, the improvements relate to the recovery of unreacted carbon and temperature moderation of the reactor used to produce the synthesis gas.

The oxygen-blown partial oxidation of petroleum feedstocks requires the addition of a tempering medium such as steam to keep the reactor temperature within certain permissible limits. These limits are set by the economy of operation and the temperature restrictions of the reactor refractory material. Past practice has been to inject high pressure superheated steam into the petroleum feedstock charged to the partial oxidation generator. This practice is effective but usually requires either a waste heat recovery apparatus or a supply of clean, non-polluting fuel to operate a special boiler used to produce the tempering steam. These requirements add to the cost of the equipment utilized in the process, attendant maintenance costs and energy requirements.

A problem connected with the process is handling the unconverted or unreacted carbon. Normally the carbon is scrubbed from the reactor gaseous effluent with water resulting in a water and/or oil slurry which is thereafter contacted with petroleum naphtha. The naphtha preferentially wets the carbon and separates the carbon from the water stream. The carbon may then be transferred to a heavy oil stream by mixing heavy oil with the naphtha. The heavy fraction from the distillation process contains substantially all of the unreacted carbon which can be used as the feedstock for the partial oxidation reactor thus completely utilizing the carbon contained in the oil charge to produce a useful product. The process briefly described above requires a substantial amount of equipment and energy to separate and recycle the carbon.

SUMMARY OF THE INVENTION

The invention herein relates to concentrating the water-carbon slurry from the reactor gaseous effluent scrubbing step, mentioned above, to about 5 to 7 percent carbon, mixing the concentrated slurry with a fuel oil and returning same without vaporization to the partial oxidation generator as a substitute for the commonly used superheated high-pressure steam.

Various means may be used to accomplish the required concentration of the slurry stream including gaseous-flotation and electro-flotation. The gaseous flotation process separates the carbon as a carbon-water slurry, providing a more useful form, in the concentrations required. One such method described herein is the utilization of a flotation tank and a screw conveyor which removes carbon-water concentrate from the surface of the liquid within the flotation drum for transmittal to a second drum where the carbon-water concentrate may be slurried with oil in such a way that the resulting properties of the mixture allow conventional processing equipment to be used.

The carbon-water concentrate is transmitted from the flotation drum to the oil slurry drum by means of the screw conveyor system which would be operating under the control of a variable speed motor for providing proper removal of carbon in the concentration required.

The screw conveyor discharges the concentrated carbon-water slurry onto a baffle plate therein which is continuously washed with oil. The oil runs off the baffle plate into a surge area of the oil slurry drum which may contain mixers for providing a more uniform mixture of the oil slurry and carbon-water concentrations. The concentrated slurry and oil mixture is conducted into the reactor through a fuel preheater in a conventional manner. A portion of the oil slurry mixture is recirculated through the oil slurry tank to enhance the mixing properties.

It is therefore an object of the present invention to provide a more efficient process for the production of synthesis gas by partial oxidation.

It is another object of the present invention to temper the operating temperature of a partial oxidation reactor utilizing water as the tempering medium.

It is yet another object of the present invention to handle the unreacted carbon produced during the partial oxidation of petroleum feedstocks.

It is still another object of the present invention to provide a technique for concentrating water-carbon slurry resulting from the washing of reactor effluent gas.

It is another object of the present invention to mix and recirculate concentrated carbon-water slurry with petroleum feedstock in an efficient manner.

DESCRIPTION OF THE PREFERRED EMBODIMENT

Figure 1:
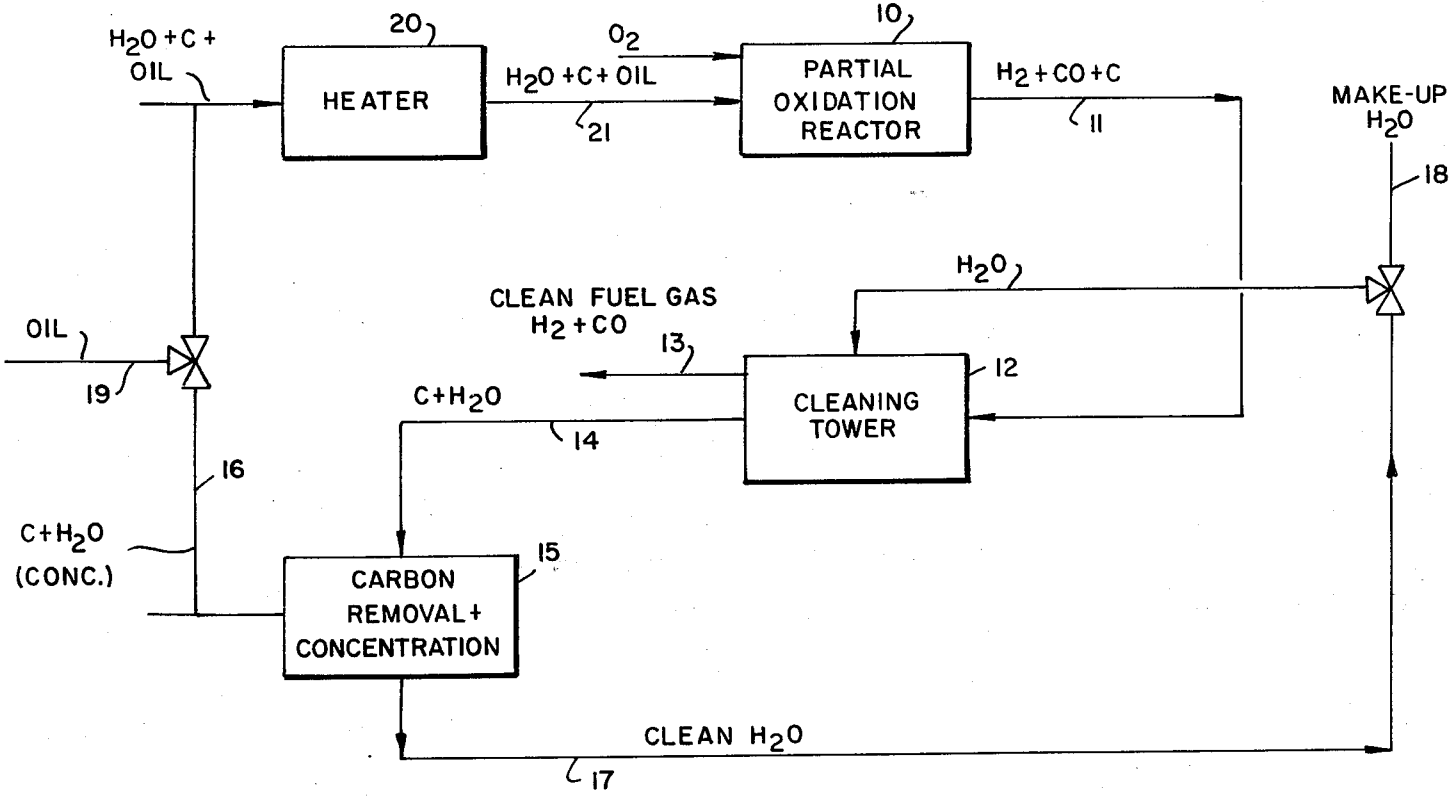
FIG. 1 illustrates the process of the present invention in block form for the concentration and utilization of unreacted carbon produced during the partial oxidation process.

In FIG. 1 there is illustrated in block form, a diagram of the partial oxidation and carbon removal process of the present invention. A partial oxidation reactor 10 combines a petroleum feedstock with oxygen in a known manner to produce fuel gas consisting of carbon monoxide and hydrogen plus unreacted carbon ($CO + H_2 + C$). The outlet 11 of the reactor 10 feeds a cleaning tower 12, which receives water therein for washing the gaseous effluent and delivering clean fuel gas from outlet 13. Water washing of the effluent removes the entrained carbon from the gas and results in a carbon-water slurry which is conveyed from the cleaning tower 12 through outlet 14. The carbon-water slurry is typically about 0.5 percent by weight carbon. The slurry is delivered to a carbon removal and concentration apparatus 15. In accordance with techniques to be described further herein, a concentrated slurry of carbon and water of about five to seven percent carbon by weight is delivered to the output 16.

The concentration of the carbon at 15 results in a relatively clean water in outlet line 17 which may be recirculated to the cleaning tower 12 having an additional make up water inlet 18.

The concentrated slurry at 16 is mixed with a petroleum feedstock (oil), at 19, which is thereafter conducted to a preheater 20 and through line 21 to the partial oxidation reactor 10. The heater outlet 21 supplies the fuel oil and unreacted carbon for the partial oxidation reactor 10 as well as water which serves as a moderator for the reaction in 10.

The system described above therefore handles all of the unreacted carbon in a manner which supplements the fuel for production of the fuel gas and eliminates the necessity for providing a stream of superheated steam to the reactor 10. Provision for tempering steam would require a heater and supplementary fuel supply. It should be noted that the fuel supply necessary for producing the superheated steam would preferably be a clean fuel so as to reduce the amount of equipment necessary for cleaning the stack gases therefrom. The associated equipment and fuel requirements for such a process would add considerable to the cost of building and maintaining the partial oxidation plant.

Figure 2:
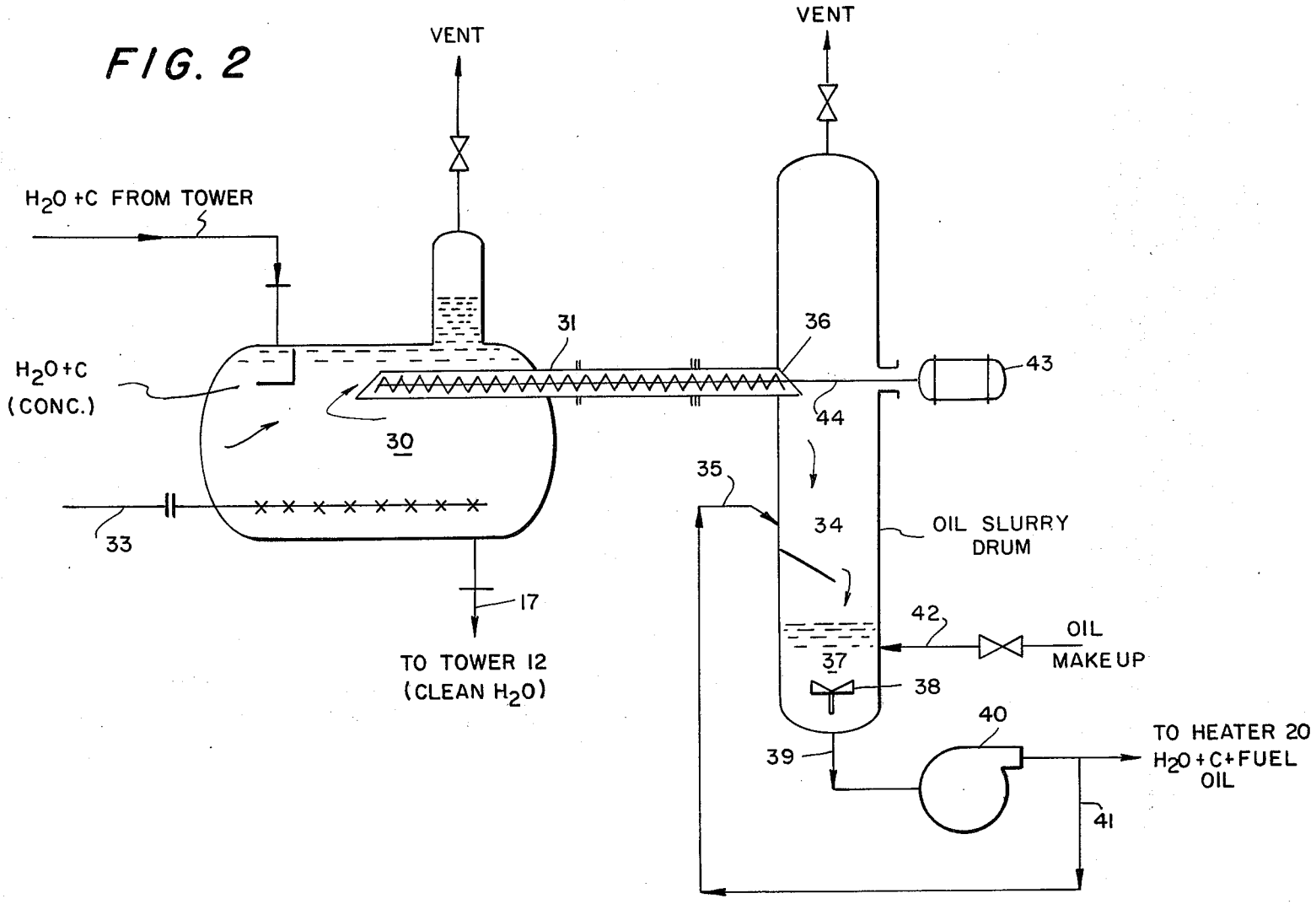
FIG. 2 is a detail of a flotation drum for concentrating the carbon water slurry produced at one stage during the process described in FIG. 1.

An apparatus for the removal and concentration of carbon which is shown generally at 15 and FIG. 1 is detailed in FIG. 2 and described below.

A carbon-water slurry drum 30 receives the output of the tower 12 at inlet 14. The drum 30 has a screw conveyor 31 which removes carbon and water in a concentrated form for delivery to an oil slurry drum 32. The carbon-water slurry from the tower 12 is concentrated by means of flotation utilizing a gas injector 33. It should be understood that an electrode may be substituted for the gas injector 33 for producing bubbles within the tank 30 to float the carbon to the top of the tank 30 in a more concentrated form. Water outlet 17 shown above in FIG. 1 conducts relatively clean water back to the tower 12 as described.

The oil slurry drum 32 has a baffle plate 34 disposed therein to receive a supply of oil through an inlet supply line 35. The concentrated carbon and water slurry delivered at the outlet 36 of the screw conveyor 31 falls on the baffle 34, and is partially mixed with the oil washing the baffle 34. A surge area 37 in the tank 32 may be equipped with a propeller-type mixer 38 or other apparatus suitably adapted for agitating the slurry oil mixture. An outlet line 39 of the slurry drum 32 delivers the oil slurry mixture to a circulating pump 40, which delivers the oil slurry mixture to the heater 20 as shown in FIG. 1. A portion of the oil slurry mixture is recirculated from an outlet of the circulating pump 41 to the inlet 35 of the oil slurry drum 32.

Fuel oil to the system is supplied through an inlet 42 to the slurry drum 32 as indicated in drawing. This may be supplied in controlled amounts to regulate the concentration of oil and slurry mixture in the surge portion 37 of the drum 32. Likewise the variable speed motor 43 driving the screw conveyor 31 through shaft 44 may be controlled at various speeds in order to regulate the amount of carbon slurry injected into the slurry drum 32.

The present invention therefore has the benefits of simplifying a process for partial oxidation while at the same time utilizing by-product unreacted carbon in a mixture with water to regulate the temperature of the oxidation reactor as well as supplement the fuel supply for reacting the byproduct material. Furthermore, a means has been devised for regulating the concentration of carbon-water input to the system to a fairly concentrated weight range of 5 to about 7 percent carbon in water which previously was thought too highly concentrated to be useful.

While the foregoing description has been limited to what is considered to be the preferred environment of the present invention and it will be obvious to those skilled in the art that various changes and modifications may be made therein without departing from the invention, and it is intended in the appended claims to cover all such changes and modifications as fall within the true spirit and the scope of the invention.

What is claimed is:

1. A method for the recovery of unreacted carbon produced by reaction of fossil fuel and oxygen in a partial oxidation reactor to produce an effluent stream of synthesis gas and entrained carbon comprising of the steps of: washing the effluent stream with water to remove unreacted carbon therefrom to produce a stream of clean synthesis gas and a stream of water and entrained carbon, concentrating the stream of carbon and water formed during the cleaning step into a slurry of carbon and water containing about 5 to 7 percent by weight of carbon and producing a stream of relatively clean water substantially free of carbon, introducing said slurry into a vessel, combining the slurry in said vessel with a fuel oil, mixing said fuel oil and slurry in said vessel to produce a feed stream, then pumping the feed stream through a preheater and injecting the feed stream, without vaporization, into the partial oxidation reactor.

2. The method as described in claim 1 further including the steps of: removing the clean water produced during the concentration step and recirculating said clean water so removed for the washing step for removing further carbon from the effluent produced by the partial oxidation reactor.

3. The method as described in claim 1 wherein the concentration of the carbon in the water is about 5 to weight percent carbon.

4. The method of claim 1 wherein the step of combining the slurry and the fuel oil stream includes the step of recirculating said slurry and fuel oil stream in a surge area.

5. The method of claim 1 wherein the step of combining the slurry and fuel oil stream includes the step of agitating the mixture.

* * * * *